US007331715B2

(12) United States Patent
Miller et al.

(10) Patent No.: US 7,331,715 B2
(45) Date of Patent: Feb. 19, 2008

(54) VALVE ELEMENT

(75) Inventors: Richard T. Miller, Oakland, CA (US); Rebecca S. Giesfeldt, Oakland, CA (US)

(73) Assignee: The Glad Products Company, Oakland, CA (US)

( * ) Notice: Subject to any disclaimer, the term of this patent is extended or adjusted under 35 U.S.C. 154(b) by 409 days.

(21) Appl. No.: 10/765,514

(22) Filed: Jan. 26, 2004

(65) Prior Publication Data

US 2005/0161465 A1 Jul. 28, 2005

(51) Int. Cl.
*B65D 33/01* (2006.01)

(52) U.S. Cl. ..... 383/103; 383/100; 383/44

(58) Field of Classification Search ..... 222/92, 222/494; 383/100, 103, 43–44, 49, 52; 426/118; 206/524.8; 137/551; 220/202, 203.01, 203.11, 220/203.16, 203.29

See application file for complete search history.

(56) References Cited

U.S. PATENT DOCUMENTS 2,604,297 A * 7/1952 Winstead ..... 137/223
2,927,722 A * 3/1960 Metzger ..... 383/94
2,946,502 A * 7/1960 Metzger ..... 383/94
4,134,535 A 1/1979 Barthels et al.
4,310,118 A 1/1982 Kisida et al.
4,653,661 A 3/1987 Buchner et al.
4,715,494 A 12/1987 Heitzenröder et al.
4,890,637 A 1/1990 Lamparter
5,326,176 A 7/1994 Domke
5,500,663 A 3/1996 Ujita et al.
5,584,409 A * 12/1996 Chemberlen ..... 220/89.1
5,727,881 A 3/1998 Domke
5,782,266 A * 7/1998 Domke ..... 137/551
5,809,787 A * 9/1998 Zittel ..... 62/63
6,056,439 A 5/2000 Graham
6,059,457 A * 5/2000 Sprehe et al. ..... 383/63
6,513,659 B1 * 2/2003 Ogura et al. ..... 206/524.8
6,662,827 B1 * 12/2003 Clougherty et al. ..... 137/859
7,178,555 B2 * 2/2007 Engel et al. ..... 137/852

FOREIGN PATENT DOCUMENTS

EP 23703 A1 * 2/1981

* cited by examiner

*Primary Examiner*—Nathan J. Newhouse
*Assistant Examiner*—Jack Morgan
(74) *Attorney, Agent, or Firm*—Thomas C. Feix

(57) ABSTRACT

Provided is a valve element for venting fluids, such as gas or liquids, entrapped in a packaging enclosure. The valve element includes a base element having an aperture disposed through it and a membrane having a protruding raised portion. The membrane is attached to and overlays the base element. The raised portion is selectively configurable between a concave position and a convex position by applying an external force against the apex of the raised portion. When configured in the convex position, the raised portion is spaced apart from the aperture allowing fluid communication therethrough. When configured in the concave position, the raised portion obstructs the aperture preventing fluid communication therethrough. To vent air passing through the aperture into the environment, an expandable channel for providing a clearance is provided between the membrane and the base element.

25 Claims, 13 Drawing Sheets

VALVE ELEMENT

FIELD OF THE INVENTION

This invention pertains generally to valve elements and more particularly to venting valve elements that enable fluids, such as gases and liquids, to vent therethrough. The present invention finds particular utility in venting trapped fluids from an enclosed volume of a packaging enclosure.

BACKGROUND OF THE INVENTION

Packaging enclosures, such as the plastic bag, are used to enclose items varying from foodstuffs to manufactured parts. The packaging enclosure typically includes a continuous surface made from a web of flexible material that defines an internal volume for holding the items. To insert the item into the packaging enclosure, an opening is disposed through the surface of the enclosure to the internal volume. Once the item is inserted, the opening may be sealed to enclose the item and prevent the item from unintentionally falling out. In some instances the enclosure may be sealed in an airtight manner to, for instance, keep foodstuffs fresh or prevent enclosed fluids from leaking. Common methods of sealing packaging enclosures include fastening strips, heat-sealing, and adhesives.

As will be appreciated, when inserting items into the enclosure, air or other gas from the surrounding environment is also likely to fill the internal volume. It may be desirable to evacuate the entrapped air to, for instance, preserve foodstuffs or reduce the overall volume of the packaging enclosure. To evacuate the air, often the surface of the enclosure is collapsed around or bunched up about the item thereby forcing the air back through the opening prior to sealing the enclosure. Bunching up the packaging enclosure may, however, distort the opening in a manner that makes sealing the enclosure difficult. Also, some air may re-enter the internal volume before sealing is accomplished.

To prevent these disadvantages, it is common to partially seal the opening of the enclosure prior to evacuating the entrapped air. The packaging enclosure is then collapsed about or bunched up about the item to vent the trapped air or gas through the remaining unsealed part of the opening. After evacuation, the remainder of the opening is sealed. It will be readily appreciated that partial sealing and evacuation methods are relatively complicated and certainly not conducive to achieving an efficient rate in enclosing numerous packaging enclosures. Accordingly, there is a need for simplifying the airtight sealing of packaging enclosures.

BRIEF SUMMARY OF THE INVENTION

The present invention provides a simple-to-operate valve element that can be included as part of a packaging enclosure for venting air or other entrapped gases and fluids from the packaging enclosure. Fluid communication between the environment and the internal volume of the packaging enclosure is established through the valve element that can be selectively opened for evacuation and closed for sealing. To accomplish this, the valve element includes a base element attached to a surface of the packaging enclosure and a membrane overlaying the base element. The base element is made from a flexible material and includes an aperture surrounded by a peripheral seat portion. When attached, the aperture corresponds to an opening disposed through the surface of the packaging enclosure. The membrane is made of a semi-rigid material and includes a border portion and a raised portion that can be selectively configured between a concave position and a convex position.

When in the convex position, the raised portion protrudes away from the base element enabling fluid communication between the internal volume and the environment. Accordingly, the valve element is opened and gases or fluids can either be evacuated from or drawn into the internal volume. When placed in the concave position, the raised portion impinges against the base element thereby obstructing the aperture. Accordingly, the valve element is closed. A channel for providing a clearance is formed between the membrane and the base element to complete fluid communication between the aperture and the environment.

Switching the raised portion between the concave and convex positions is facilitated by using a semi-rigid material for the membrane. Specifically, the rigidity of the material provides the raised portion with the tendency to maintain its protruding shape, either concave or convex, in the absence of any external forces. However, when a sufficient external force is applied to the raised portion, the raised portion collapses and traverses across the plane defined by the membrane. The external force may be applied by the hands of a user. The rigidity of the material also prevents the raised membrane from unintentionally switching positions and thereby unexpectedly sealing or unsealing the packaging enclosure.

Thus, an advantage of the present invention is that it selectively enables fluid communication between an enclosed volume of a packaging enclosure and the external environment. Another advantage of the present invention is that it enables air or other entrapped gases and fluids to be vented after sealing the opening of the packaging enclosure. Another advantage is that the valve element, which is operated by applying an external force, is easy to use. Another advantage is the tendency of the valve element to resist unintentionally opening or closing. These and other advantages and features of the present invention will become apparent from the detailed description and the accompanying figures.

DETAILED DESCRIPTION OF THE DRAWINGS

Figure 1:
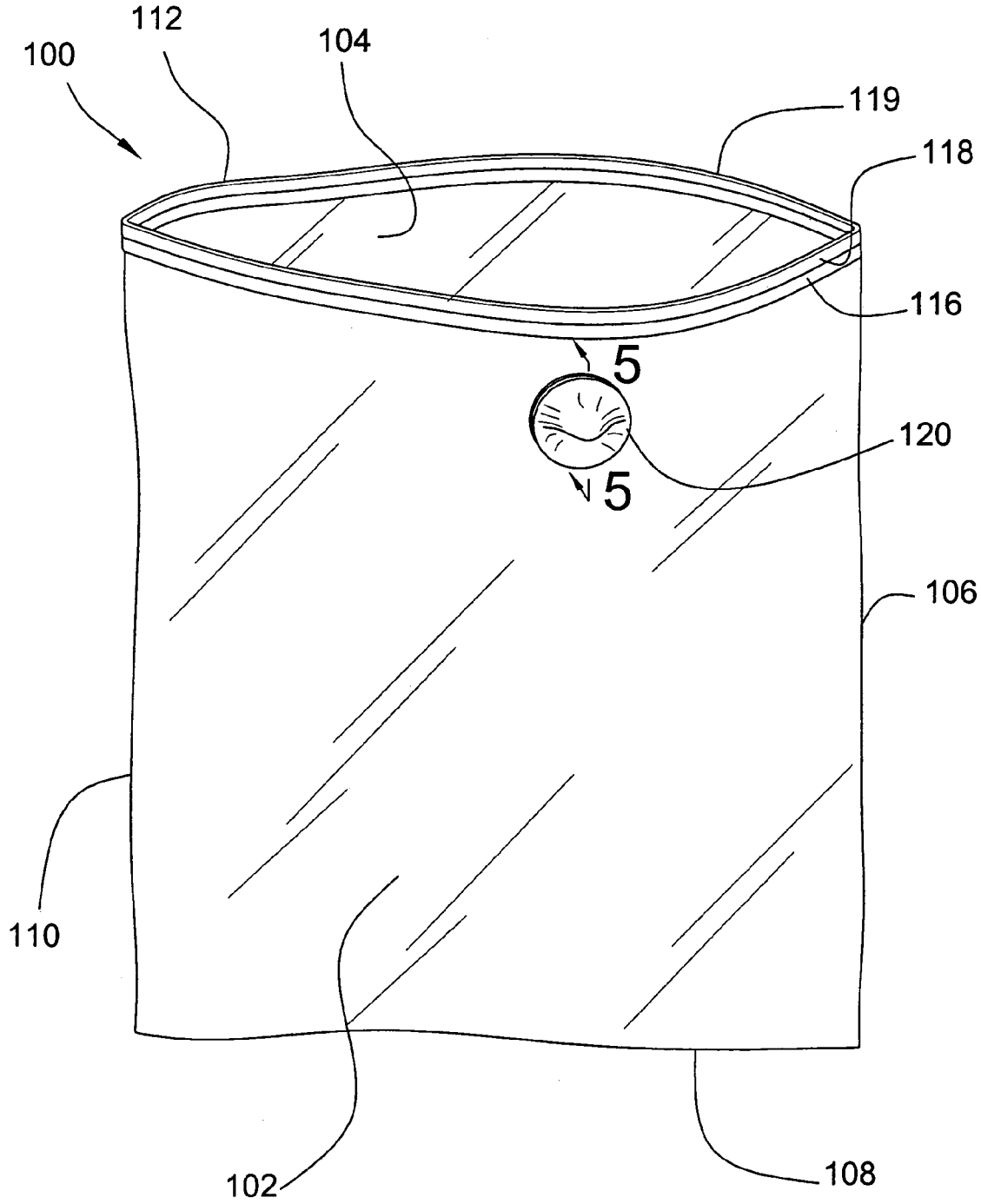
FIG. 1 is a front perspective view of a packaging enclosure including a valve element designed in accordance with the teachings of the present invention.

Now referring to the drawings, wherein like reference numbers refer to like elements, there is illustrated in FIG. 1 an illustrative packaging enclosure 100 incorporating a valve element 120 designed in accordance with the teachings of the present invention. The illustrative packaging enclosure 100 can be in the form of a flexible, two-sided plastic bag, though in other embodiments, the bag design and material may vary. Plastic bags of the illustrative type have a first sidewall 102 and an opposing second sidewall 104 sealed together along a first side edge 106, a closed bottom end 108, and a second side edge 110. The first and second sidewalls 102, 104 are unsealed at the top end 112 to form an opening through which items can be inserted and removed from the plastic bag 100. The first and second sidewalls may be made from flexible webs of transparent thermoplastic material that are sealed together in a high-speed manufacturing process.

To close the top end 112 of the plastic bag 100, in the illustrated embodiment the fastening strips 116 are molded to the first and second sidewalls 102, 104 parallel to the top end 112. The fastening strips 116, as will be appreciated by those of skill in the art, include a first fastening strip 118 and a second fastening strip 119, both of which can be made from extruded plastic. In operation, the strips engage to form a seal which closes the top end. Of course, in other embodiments, other methods such as use of light tack adhesive, heat-sealing, or electrostatic cling can be employed to close the top end.

To vent fluids entrapped in the plastic bag 100 once an item has been inserted and the top end 112 sealed, the flexible bag can be manipulated to force fluids, such as gases or liquids, through the valve element 120. Specifically, the valve element 120 can be opened and the plastic sidewalls 102, 104 pressed together to force fluids from the enclosed volume through the opened valve element. To prevent fluids from re-entering the plastic bag once the enclosed volume has been evacuated, the valve element 120 can simply be closed.

Figure 2:
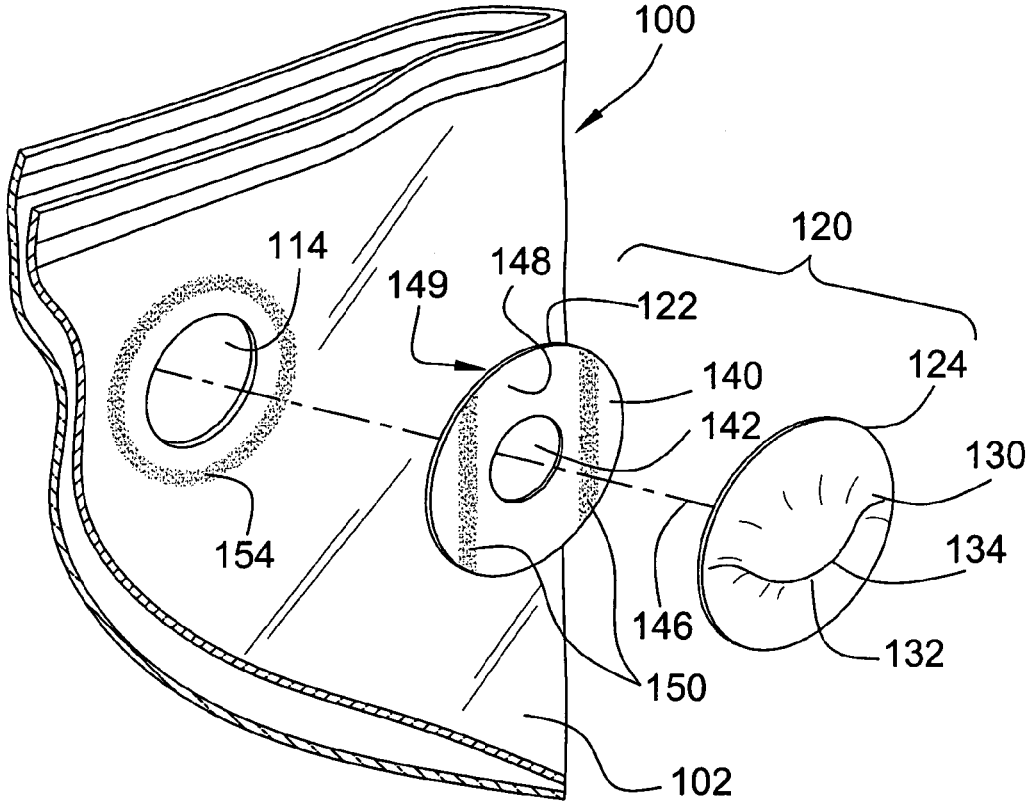
FIG. 2 is an exploded view of the valve element including a raised membrane and a base element.

Referring to FIG. 2, an embodiment of the valve element 120 is illustrated with reference to the plastic bag 100. The valve element 120 may include a base element 122 that is placed adjacent the first sidewall 102 of the bag 100 and a raised membrane 124 that overlays the base element. It should be noted that the base element 122 and the membrane 124 can be assembled together to form the valve element 120 either prior to or at the time of attaching the valve element to the bag.

Referring to FIG. 2, the base element 122 may be formed from a thin, planar piece of material that includes a peripheral seat portion 140 that surrounds an aperture 142. In the illustrated embodiment, the shape of seat portion 140 is annular and the aperture 142 is accordingly circular and concentrically located within the seat portion, though in other embodiments various other shapes and arrangements are contemplated. The circular aperture 142 also defines an axis 146 that is generally perpendicular to the planar base element 122. The planar shape of the base element further provides a first surface 148 oriented towards the membrane 124 and an opposing second surface 149 oriented towards the bag 100. Preferably, the material for the base element is a flexible plastic such Low Density Polyethylene ("LDPE"). Other possible materials for the base element include vinyl, elastomers, latex, neoprene, and silicone rubber.

Figure 3:
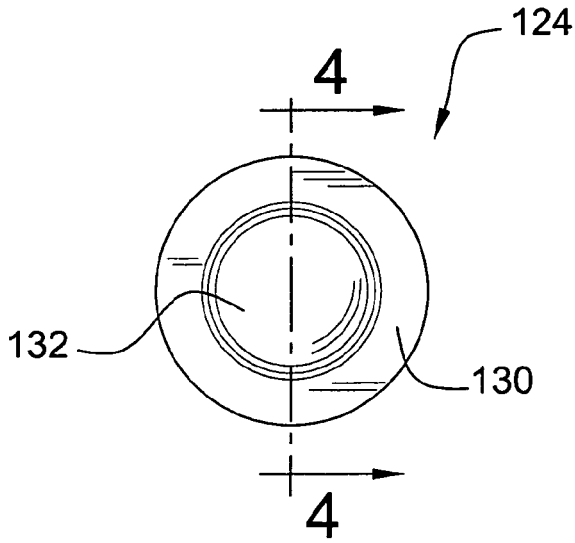
FIG. 3 is a top plan view of the membrane.
Figure 4:
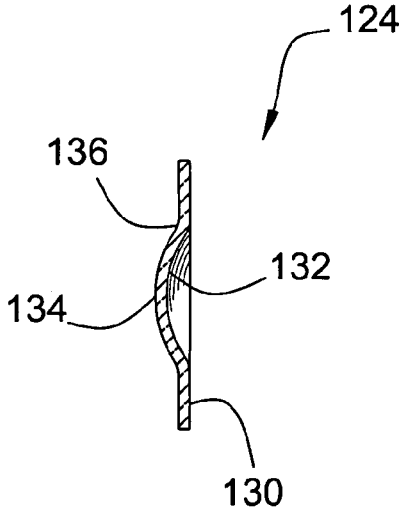
FIG. 4 is a sectional view of the membrane taken along line 4-4 of FIG. 3.

The membrane 124, as illustrated in FIGS. 2, 3, and 4, may be made from a thin sheet of semi-rigid material and includes a border portion 130 that surrounds a raised portion 132. The raised portion 132 may be formed as a rounded or semi-spherical dome protruding from the plane defined by the border portion 130. As a result of its rounded shape, the raised portion 132 includes an apex 134 that forms the outermost protruding part of the raised portion and an inflection region 136 that integrally connects the apex to the border portion 130.

In the illustrated embodiment, the border portion 130 has a circular outline and the raised portion 132 is centrally located within the annular border portion 130. Preferably, the raised portion 132 is about one-half the diameter of the border portion 130. Also preferably, the raised portion 132 is aligned with the axis 146 defined by the aperture 142 and the circular outline of the border portion 130 is coextensive with the circular outline of the peripheral seat portion 140. Preferably, the raised portion 132 should be larger in size (i.e. circumference) than the aperture 142.

Figure 7:
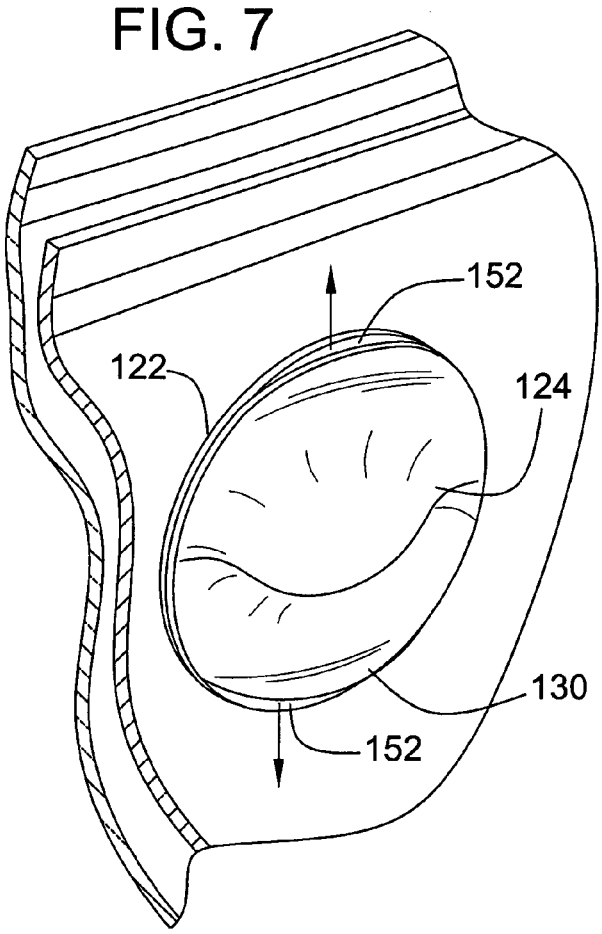
FIG. 7 is a perspective view of the valve element and packaging enclosure illustrating the valve element venting through a channel providing a clearance.

To form the assembled valve element, referring to FIG. 2, the membrane 124 is attached to the base element 122 preferably by using adhesive such as a pressure sensitive or solvent adhesive. Adhesive can be applied to the first surface 148 of the base element 122, preferably in two strips 150 along the peripheral seat portion 140 on either side of the aperture 142. The membrane 124 is then pressed adjacent the first surface 148 so that the adhesive secures the border portion 130 to the peripheral seat portion 140. Accordingly, the raised portion 132 and the aperture 142 are aligned along the common axis 146. So as to not interfere with the interaction of the aperture 142 and raised portion 132, adhesive 150 only secures together the outer regions of the peripheral seat portion 140 and the border portion 130. Also, because the adhesive is applied in two strips 150, a region of both the peripheral seat portion 140 and the border portion 130 between the adhesive strips is unsecured and thereby forms a channel 152 between the membrane 124 and the base element 122. As illustrated in FIG. 7, the channel 152 can be expanded to separate the unattached regions of the membrane 124 and the base element 122 thereby providing a clearance.

Referring to FIG. 2, to enable fluid communication between the valve element 120 and the enclosed volume, the valve element is attached to the first sidewall proximate to an opening 114 disposed through the sidewall 102. The opening 114 is preferably of a larger size than the aperture 142. The valve element 120 is attached so that the opening 114 is aligned along the axis 146 with the aperture 142 and raised element 132. Attachment can be accomplished by placing adhesive 154 on the first sidewall 102 proximate to the opening 114. The second surface 149 of the base element 122 can be placed adjacent the first sidewall 102 so that the adhesive 154 secures the peripheral seat portion to the sidewall. As illustrated, the adhesive 154 is applied in a continuous ring about the opening 114 so that a complete seal is formed around the circumference of the opening between the sidewall 102 and the base element 122. Accordingly, any fluid passing through the opening must also pass through the aperture.

Acceptable adhesives for attaching the valve element to the sidewall include pressure sensitive adhesives and solvent adhesives. Also, in other embodiments, the valve element may be heat sealed onto the sidewall, either directly or with an ethylene-vinyl acetate co-polymer ("EVA") sealing layer.

Figure 5:
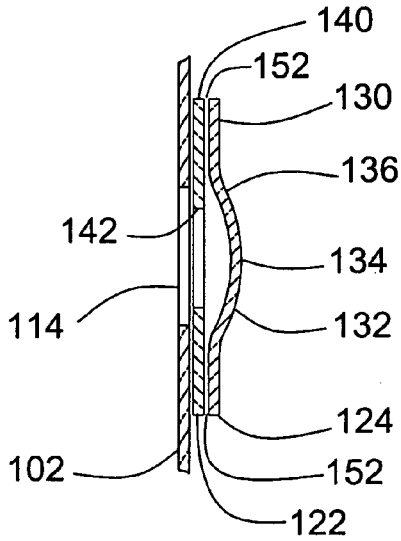
FIG. 5 is a sectional view of the valve element taken along line 5-5 of FIG. 1, illustrating the valve element in the convex or open position.

To open and close the valve element, the raised portion 132 of the membrane 124 can be alternatively placed or set into first or second positions with respect to the base element 122. The first and second positions may be concave or convex positions. For example, referring to FIG. 2, the raised portion 132 is illustrated in the convex position protruding outward from the base element 122 and thus the sidewall 102. As illustrated in FIG. 5, when in the convex position, the raised portion 132 is spaced apart from the aperture 142 enabling gas or fluid from the enclosed volume to vent through the opening 114, the aperture 142, and the channel 152. Accordingly, when the plastic bag is manipulated to collapse the enclosed volume, fluid is forced through the opening 114, the aperture 142, and the channel 152.

The vented fluid escapes through the channel to the environment. To facilitate this, referring to FIG. 7, the pressure of the venting fluid underneath the membrane 124 forces the border portion 130 and base element 122 to separate thereby expanding the channel 152 to provide a clearance. The flexible material of the base element 122 and the sidewall 102 may distort to accommodate the expansion of the channel. Since the channel 152 formed by the two strips of adhesive traverses the circular valve element 120, the venting fluid can escape from opposite edges of the valve element. It should also be readily appreciated that fluids from the environment may pass into the enclosed volume through the opened valve element.

Figure 6:
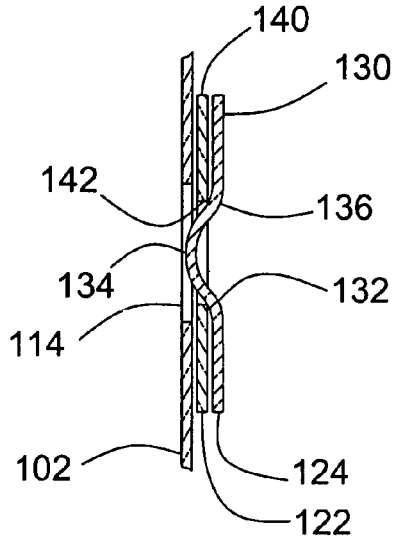
FIG. 6 is a sectional view of the valve element of FIG. 5, illustrating the valve element in the concave or closed position.

To close the valve element and prevent the return of fluids into the bag, referring to FIG. 6, the raised portion 132 is set into the concave position wherein the raised portion obstructs the aperture 142. Specifically, the apex 134 of the downward protruding raised portion 132 is received in the aperture 142 while the inflexion region 136 of the raised portion is pressed adjacent to the peripheral seat portion 140. For ensuring a seal across the aperture 142, the inflexion region 136 impinges upon and may distort the flexible peripheral seat portion 140 proximate to the aperture. In some embodiments, to enhance the sealing effect, the peripheral seat portion may incorporate cling agents, natural oils, or plastizers. As will be appreciated from FIGS. 6 and 7, impinging the inflexion region 136 against the peripheral seat portion 140 also closes the passage 152 between the base element 122 and membrane 124.

Referring to FIGS. 5 and 6, to enable switching the raised portion 132 between the concave position and the convex portion, the membrane 124 may be made from a semi-rigid thermoplastic material such as high-density polyethylene ("HDPE"), polyethylene terephthalate ("PET") or some thin metals. In some embodiments utilizing thermoplastics, the thermoplastic material may be filled with common filler materials to enhance the rigidity. When a sufficient external force is applied to the raised portion 132, the raised portion will begin to collapse about the inflexion region 136 allowing the apex 134 to traverse the plane defined by the border portion 130. The external force may be applied by the hands of a user. Because of the rigidity of the membrane material, the raised portion 132 has a tendency to maintain its shape in the absence of external force. Accordingly, as will be appreciated by those of skill in the art, at a certain state of collapse the raised portion 132 will "pop" back into shape on the opposite side of the membrane 124. Preferably, the membrane is designed so that it produces an audible "pop" or "snap" when the raised portion 132 pops across the plane of the border portion 130.

Another advantage of forming the membrane 124 from semi-rigid material is that the raised portion 132 cannot easily be distorted from the concave or convex positions. Therefore, referring to FIG. 5, the convex raised portion 132 will remain cleared from the aperture 142 and not hamper evacuation of the enclosed volume. Likewise, referring to FIG. 6, the concave raised portion 132 will remain-pressed adjacent to the peripheral seat portion 140 thereby providing a positive sealing effect. In one embodiment, to enhance the sealing effect, the base element 122 may be made of an elastic material such as foam rubber, neoprene, or silicone rubber. The elastic material is distorted by the impinging force of the inflexion region 136 and therefore urges back against the raised portion 132.

Figure 8:
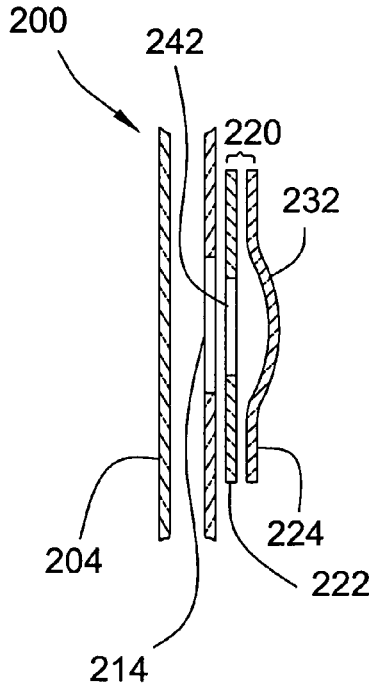
FIG. 8 is a sectional view taken through a packaging enclosure and a valve element that are configured to indicate whether the valve element is open or closed.
Figure 9:
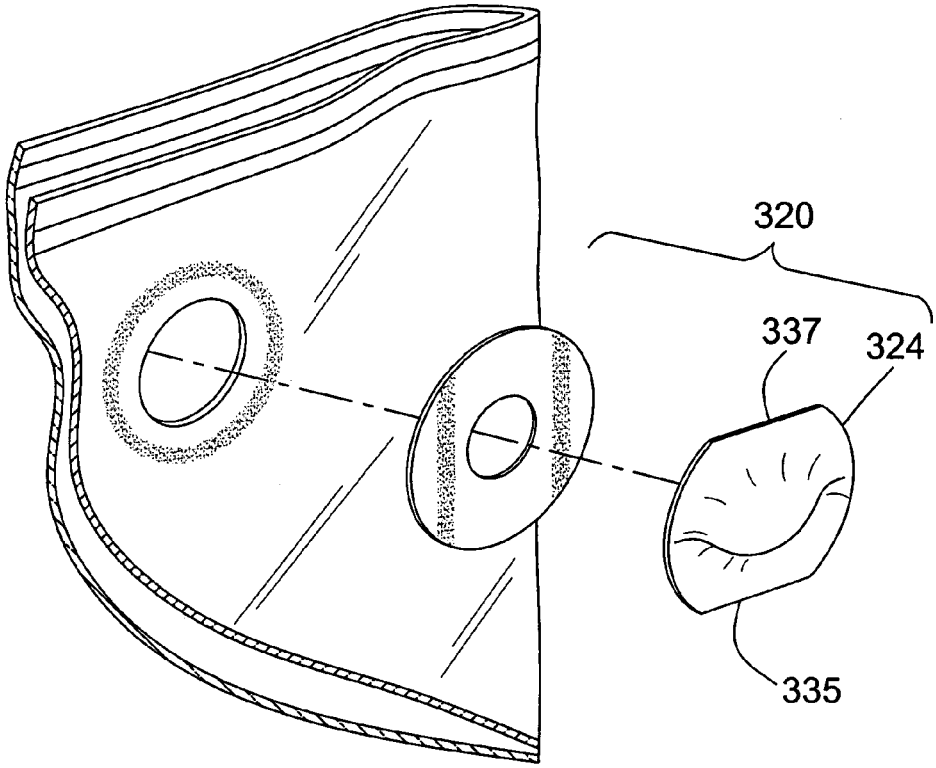
FIG. 9 is an exploded view of another embodiment of the valve element.
Figure 10:
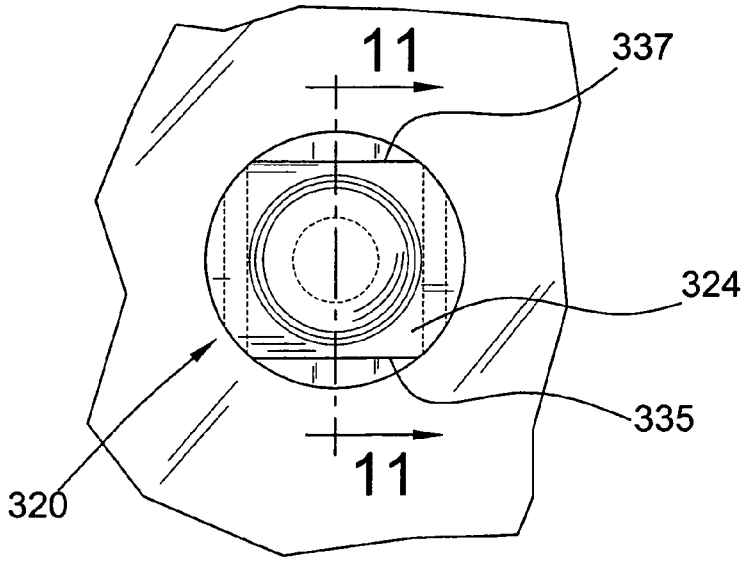
FIG. 10 is a top view of the valve element shown in FIG. 9.
Figure 11:
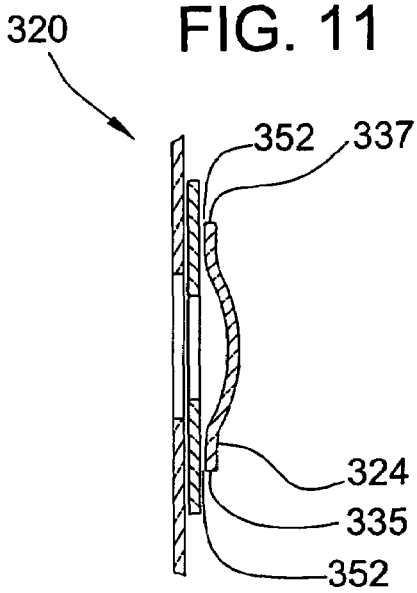
FIG. 11 is a cross sectional view taken along line 11-11 in FIG. 10.
Figure 12:
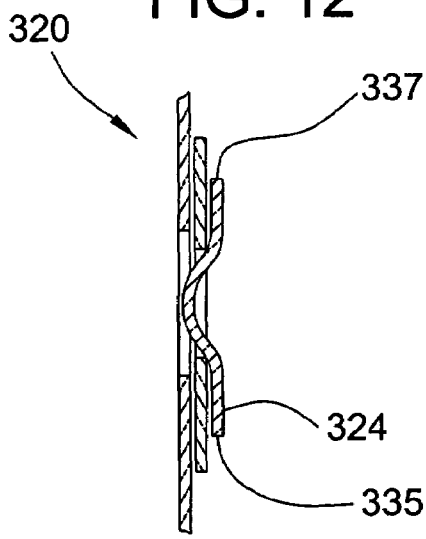
FIG. 12 is a cross sectional view of the valve element of FIG. 11 in the closed position
Figure 13:
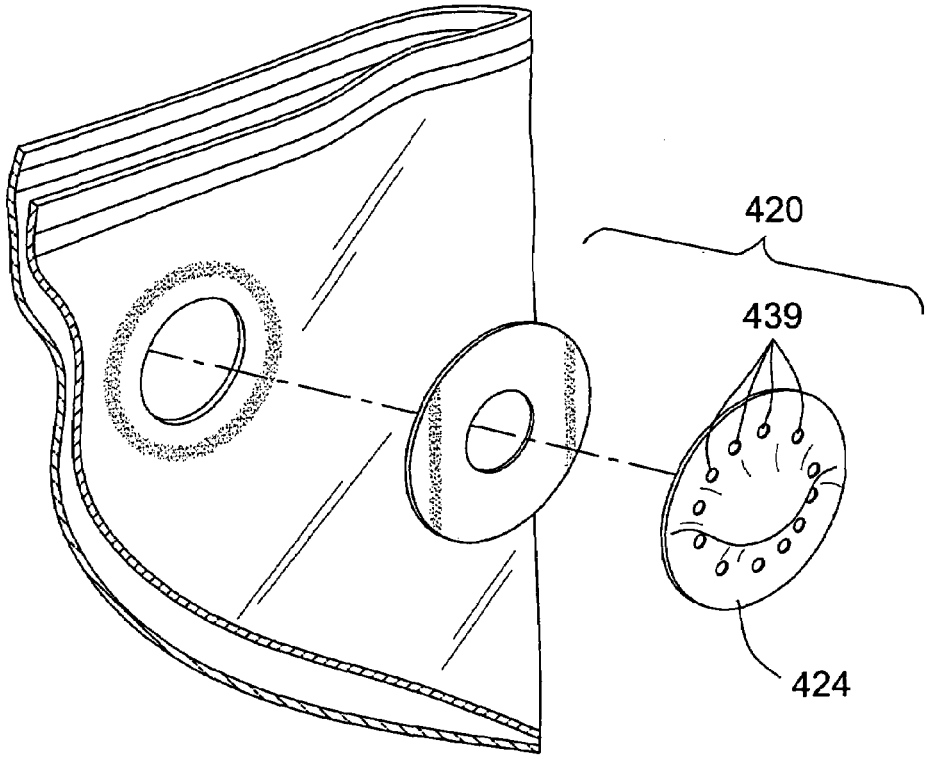
FIG. 13 is an exploded view of another embodiment of the valve element.
Figure 14:
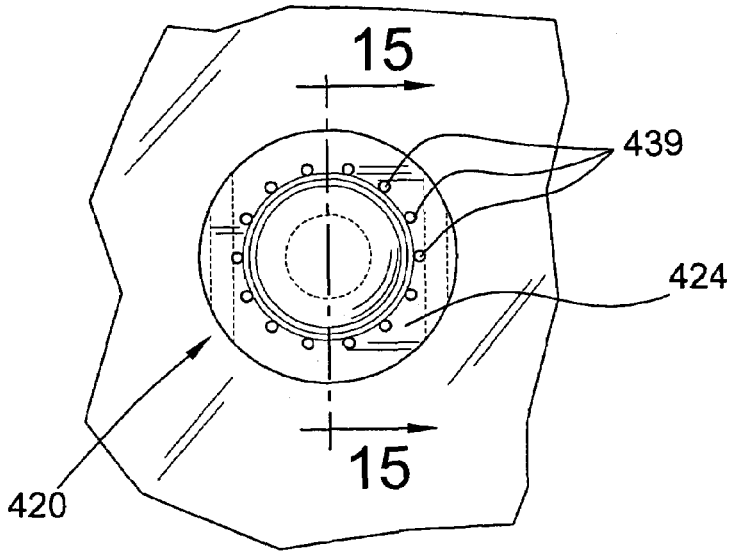
FIG. 14 is a top view of the valve element shown in FIG. 13.
Figure 15:
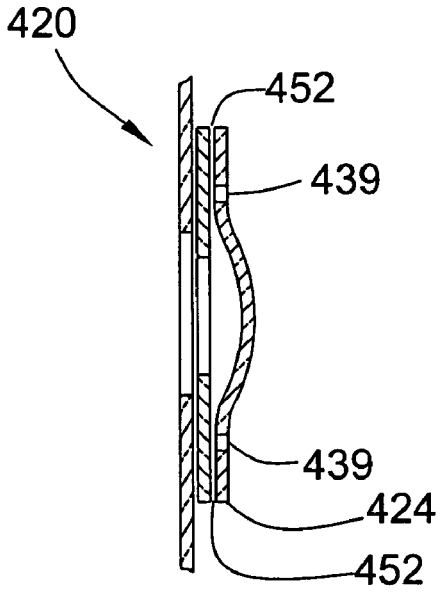
FIG. 15 is a cross sectional view taken along line 15-15 in FIG. 14.
Figure 16:
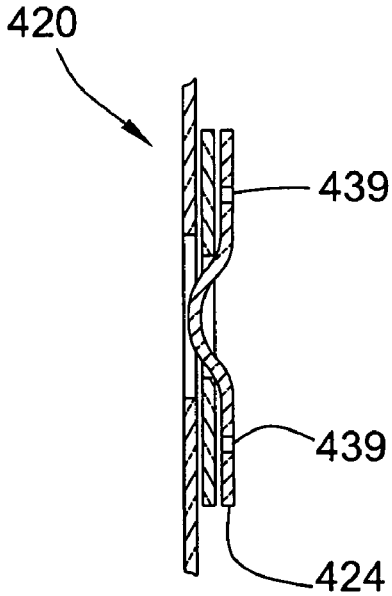
FIG. 16 is a cross sectional view of the valve element shown in FIG. 15 in the closed position.
Figure 17:
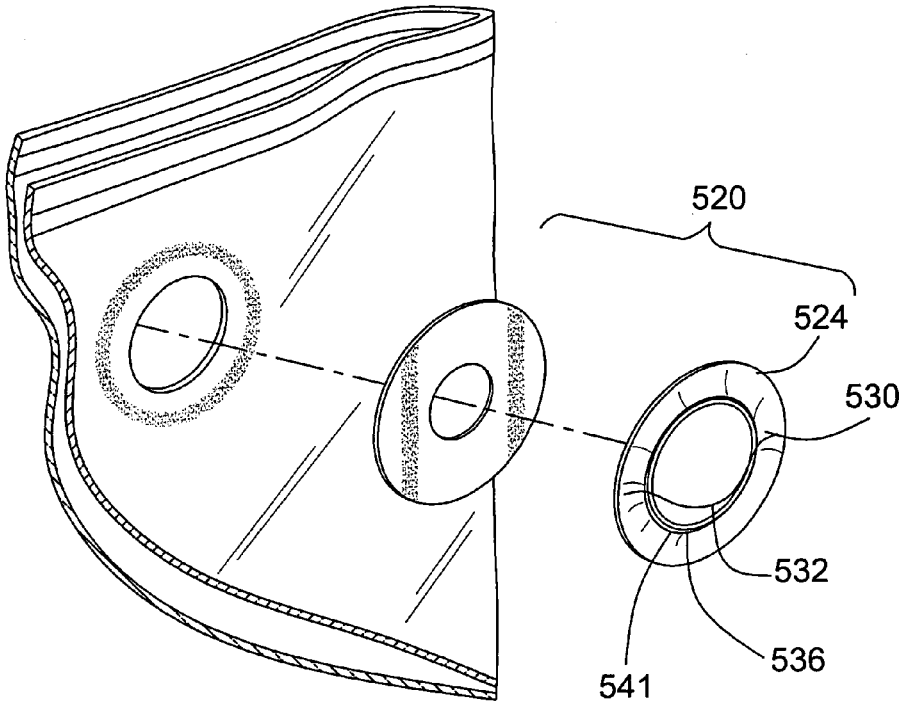
FIG. 17 is an exploded view of another embodiment of the valve element.
Figure 18:
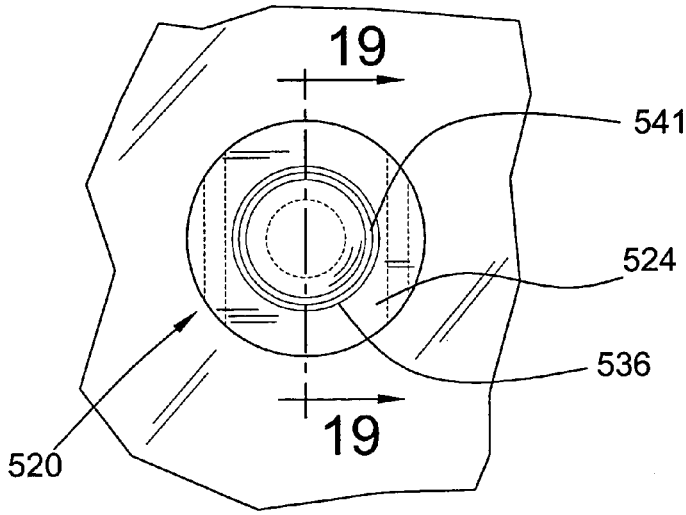
FIG. 18 is a top view of the valve element shown in FIG. 17.

Referring to FIG. 8, in another embodiment, the valve element 220 can be configured to indicate whether the valve element is open or closed. The membrane 224 can be made of a translucent material that is dyed in a particular color, such as blue. The inner surface of the second wall 204 of bag 200 is dyed with a different color, such as yellow. Due to the opening 214 in the first sidewall 202 and the aperture 242 in the base element 222, the inner surface of the second sidewall 204 is visually unobstructed through the translucent membrane 224.

When the raised portion 232 of the membrane 224 is set into the concave position, it will be adjacent to or close enough to the inner surface of the second sidewall 204 such that the different colors will blend to produce a third color indicating to a user that the valve element is closed. For example, the blue membrane and yellow sidewall will blend to produce green. When the raised portion 232 is set into the convex position, though, it will be spaced far enough apart from the second sidewall 204 that the colors will not blend and the membrane will continue to appear blue indicating that the valve element is open.

Another embodiment of the valve element is shown in FIGS. 9-12. The valve element 320 is similar to the valve element 120 except for the shape of the membrane 324. The membrane 324 includes two edges 335, 337. The edges shorten the flow path of the. channel 352 and thus provide a better flow path for the escaping fluid. In addition, the edges 335, 337 reduce the amount of material on the membrane 324 which could interfere with the flow path of the escaping air through the channel 352. This feature may be used with the other embodiments.

Another embodiment of the valve element is shown in FIGS. 13-16. The valve element 420 is similar to the valve element 120 except for the addition of vent holes 439 in the membrane 424. The vent holes 439 provide a flow path for the escaping fluid. The vent holes 439 may be used in conjunction with the channel 452 or the channel 452 may be eliminated. This feature may be used with the other embodiments.

Figure 19:
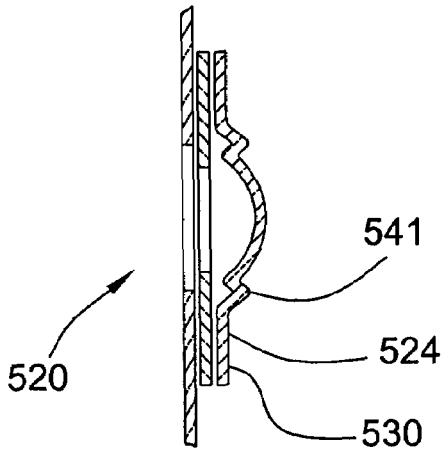
FIG. 19 is a cross sectional view taken along line 19-19 in FIG. 18.
Figure 20:
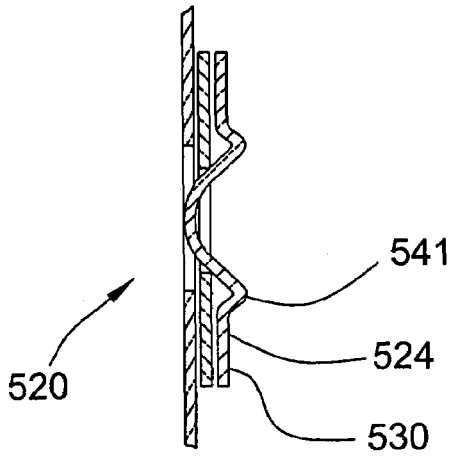
FIG. 20 is a cross sectional view of the valve element shown in FIG. 19 in the closed position.
Figure 21:
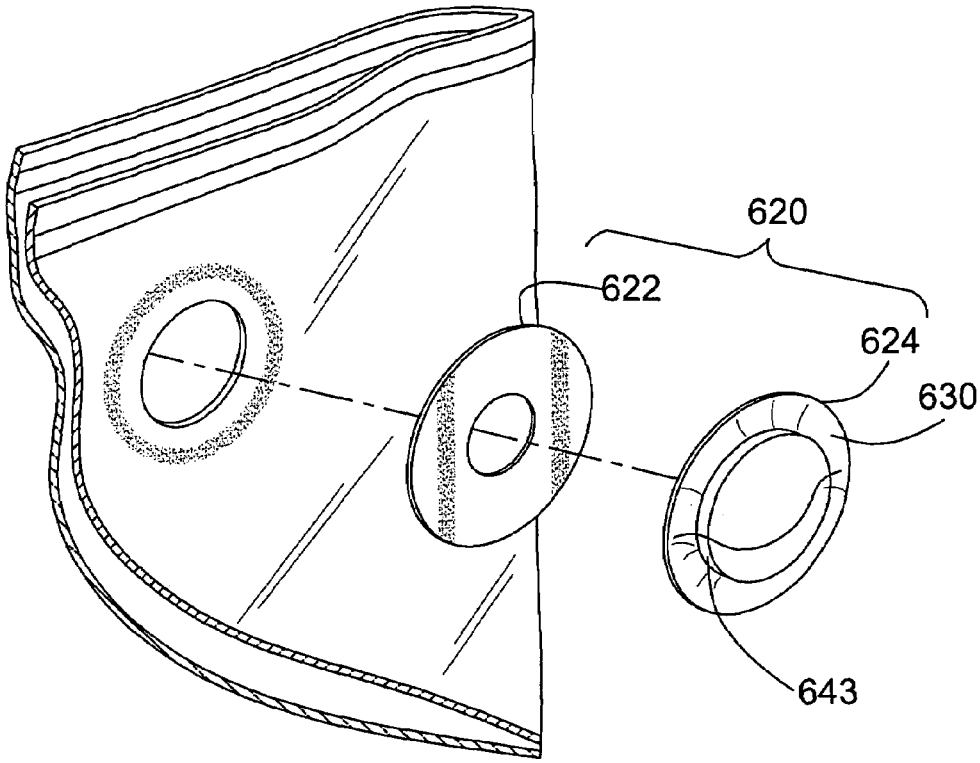
FIG. 21 is an exploded view of another embodiment of the valve element.
Figure 22:
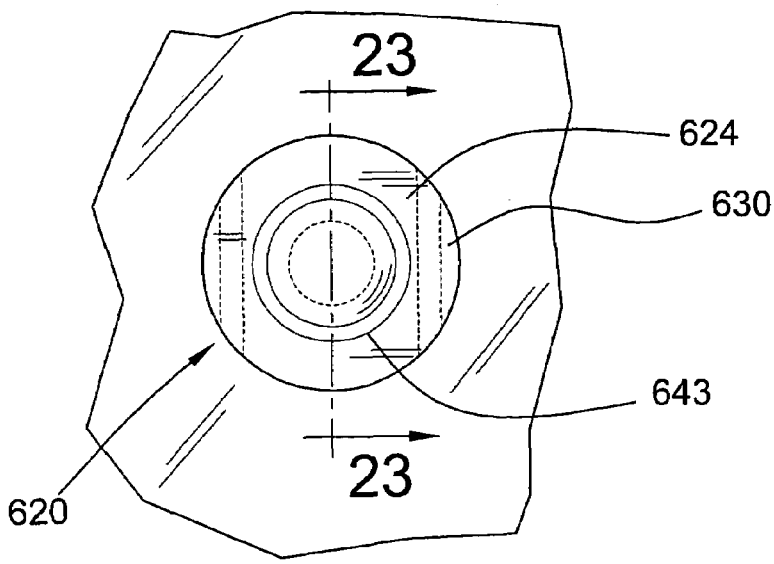
FIG. 22 is a top view of the valve element shown in FIG. 21.

Another embodiment of the valve element is shown in FIGS. 17-20. The valve element 520 is similar to the valve element 120 except that the valve 520 includes a fold 541 in the membrane 524. In this embodiment, the fold 541 is annular and may be located in the inflection region 536. The fold 541 facilitates the movement of the raised portion 532 from the first position to the second position as shown in FIGS. 19 and 20. The fold 541 may reduce the amount of distortion which may be transmitted to the border portion 530. This feature may be used with the other embodiments.

Figure 23:
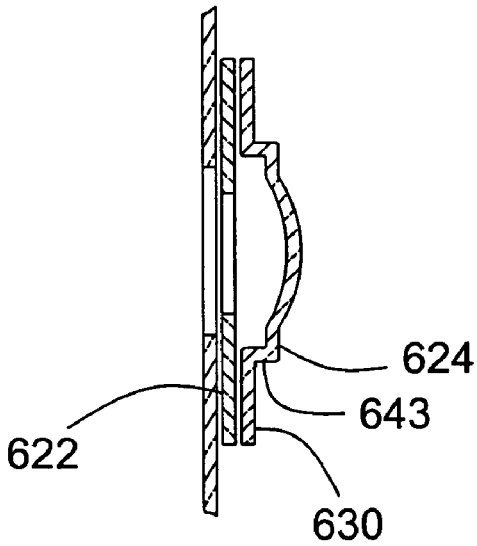
FIG. 23 is a cross sectional view taken along line 23-23 in FIG. 22.
Figure 24:
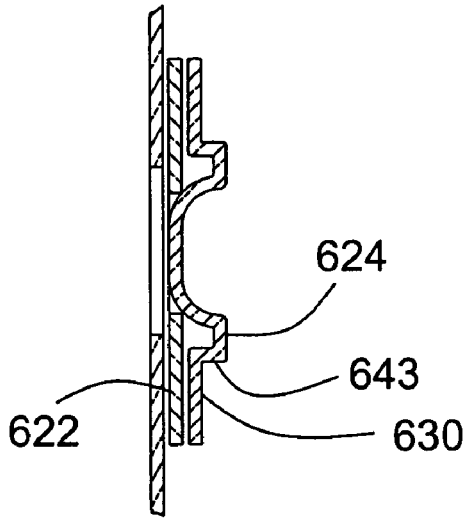
FIG. 24 is a cross sectional view of the valve element shown in FIG. 23 in the closed position.
Figure 25:
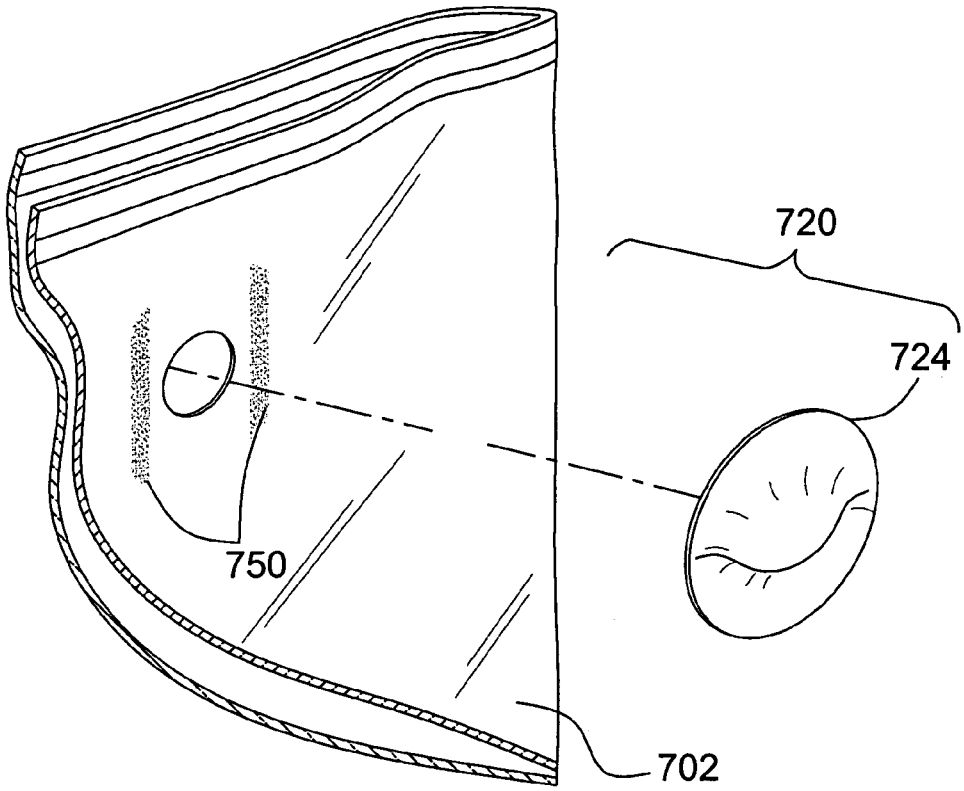
FIG. 25 is an exploded view of another embodiment of the valve element.
Figure 26:
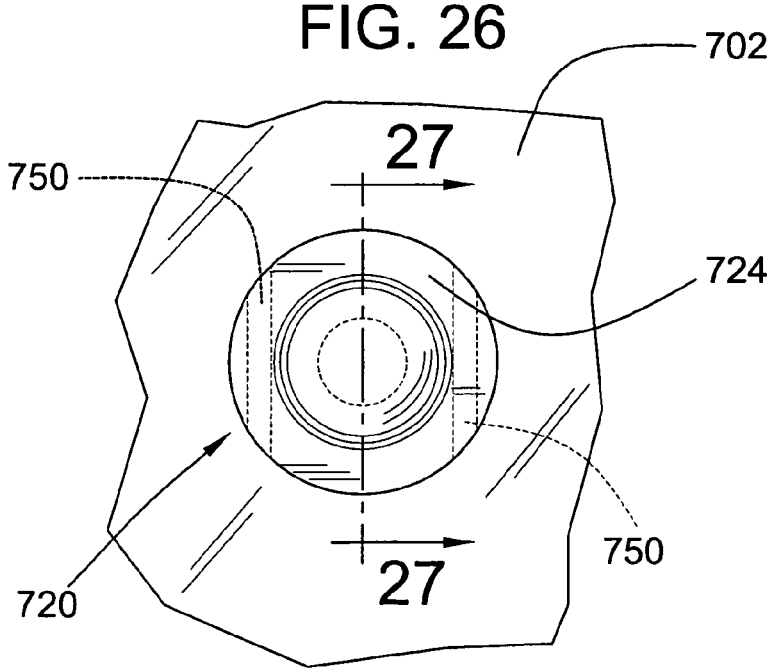
FIG. 26 is a top view of the valve element shown in FIG. 25.
Figure 27:
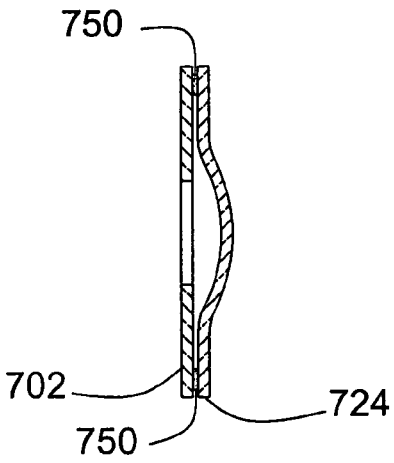
FIG. 27 is a cross sectional view taken along line 27-27 in FIG. 26.
Figure 28:
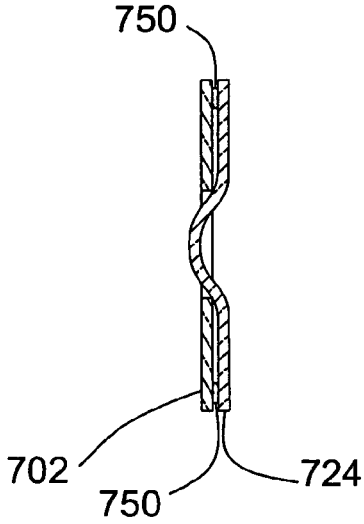
FIG. 28 is a cross sectional view of the valve element in FIG. 27 in the closed position.

Another embodiment of the valve element is shown in FIGS. 21-24. The valve element 620 is similar to the valve element 120 except that the valve element 620 has a wall portion 643. In this embodiment, the wall 643 is annular and is located in the border portion 630 of the membrane 624. The wall 643 creates greater separation between the membrane 624 and the base element 622 as shown in FIG. 23. The additional separation between the base element 622 and the membrane 624 may increase the flow path for the fluid to escape. The wall feature may be used with the other embodiments, such as the holes 439 in FIG. 13 or the fold 541 in FIG. 17.

Another embodiment of the valve element is shown in FIGS. 25-28. The valve 720 is similar to the valve 120 except that the valve 720 does not include a base element 122. The membrane 724 is attached directly to the first side wall 702 with adhesive strips 750. This feature may be used with the other embodiments.

Thus, the present invention provides an easy-to-use valve element for venting or evacuating fluid entrapped in a packaging enclosure. The valve element can be attached to a surface of the enclosure and selectively switched between an open and a closed configuration by applying an external force to the membrane overlapping the base element. When open, the raised portion of the membrane is spaced apart from the base element allowing fluid communication through the aperture. When closed, the raised portion obstructs the aperture thereby preventing fluid communication.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A valve element for selectively facilitating fluid communication therethrough comprising:

a membrane comprising a semi-rigid material and including a border portion and a raised portion, the raised portion configurable between a first position and a second position, wherein the first position is a concave position and the second position is a convex position, the membrane having a rigidity sufficient to maintain its shape in both its convex and concave position in the absence of external force applied directly to the membrane;

a base element comprising a flexible material and including a seat portion and an aperture, the seat portion having a first side attached to the border portion and a second side for attaching to a flexible sidewall of a packaging enclosure;

whereby, when set into the first position, the raised portion obstructs fluid communication through the aperture; and whereby, when set into the second position, the raised portion allows fluid communication through the aperture.

2. The valve element of claim 1, further comprising an adhesive to attach the seat portion to the border portion.

3. The valve element of claim 2, wherein the adhesive includes two strips of adhesive traversing the seat portion on either side of the aperture, the two strips of adhesive attaching the seat portion to the border portion.

4. The valve element of claim 3, wherein the two strips of adhesive are parallel.

5. The valve element of claim 1, wherein the raised portion includes an inflexion region integral with the border portion and a central apex.

6. The valve element of claim 5, wherein the apex and the aperture are aligned.

7. The valve element of claim 5, whereby, when set into the first position, the inflexion region impinges against the seat portion.

8. The valve element of claim 1, wherein the border portion is generally annular and the raised portion is centrally located within the border portion.

9. The valve element of claim 1, wherein the seat portion is generally annular and the aperture is circular and centrally located within the seat portion.

10. The valve element of claim 1, wherein the raised portion is shaped as a dome.

11. The valve element of claim 1, wherein the raised portion is larger in diameter than the aperture.

12. The valve element of claim 1, further comprising a channel providing a clearance between the border portion and the seat portion.

13. The valve element of claim 1, wherein the raised portion is about one-half the diameter of the membrane.

14. A packaging enclosure comprising a first sidewall;

a second sidewall comprising a flexible material and attached to the first sidewall to form an enclosed volume, the second sidewall including an opening;

a valve element including:

a base element comprising a flexible material and having a seat portion and an aperture, the base element attached to the second sidewall proximate the opening;

a membrane overlaying the base element, the membrane comprising a semi-rigid material and having a border portion and a raised portion, the raised portion configurable between a first position and a second position, wherein the first position is a concave position and the second position is a convex position, the membrane having a rigidity sufficient to maintain its shape in both its convex and concave position in the absence of external force applied directly to the membrane;

whereby, when in the first position, the raised portion is spaced apart from the aperture; and whereby, when in the second position, the raised portion obstructs the aperture.

15. The packaging enclosure of claim 14, wherein base element is generally planar having a first surface and an opposing second surface, the first surface attached to the membrane and the second surface attached to the first sidewall.

16. The packaging enclosure of claim 15, wherein the first surface is attached to the membrane by two strips of adhesive, the two strips of adhesive defining a channel providing clearance between the first surface and the membrane.

17. The packaging enclosure of claim 15, wherein the second surface is attached to the first sidewall by adhesive.

18. The packaging enclosure of claim 14, wherein the aperture and the opening are generally aligned.

19. The packaging enclosure of claim 14, wherein the base element is attached to the membrane by an adhesive.

20. The packaging enclosure of claim 14, wherein the base element is attached to the side wall by an adhesive.

21. The packaging enclosure of claim 14, wherein the raised portion is shaped as a dome.

22. The packaging enclosure of claim 14, further comprising fastening strips.

23. The packaging enclosure of claim 14, wherein the first sidewall comprises a flexible material.

24. A packaging enclosure comprising a first sidewall;

a second sidewall attached to the first sidewall to form an enclosed volume, the second sidewall comprising a flexible material and including an opening;

a valve element including an imperforate membrane overlaying the opening, the membrane comprising a semi-rigid material and having a border portion and a raised portion, the raised portion configurable between a first position and a second position, wherein the first position is a convex position and the second position is a concave position, the membrane having a rigidity sufficient to maintain its shape in both its convex and concave position in the absence of external force applied directly to the membrane;

whereby, when in the first position, the raised portion is spaced apart from the opening; and whereby, when in the second position, the raised portion obstructs the opening.

25. A valve element for selectively facilitating fluid communication therethrough comprising:

a membrane comprising a semi-rigid material and including a border portion lying in a plane and a raised portion, the raised portion configurable between a first position and a second position, wherein the first position is a concave position and the second position is a convex position, the membrane produces an audible pop or snap when the raised portion is moved across the plane of the border portion;

a base element comprising a flexible material and including a seat portion and an aperture, the seat portion having a first side attached to the border portion and a second side for attaching to a flexible sidewall of a packaging enclosure;

whereby, when set into the first position, the raised portion obstructs fluid communication through the aperture; and whereby, when set into the second position, the raised portion allows fluid communication through the aperture.

* * * * *